United States Patent [19]

Fuller

[11] Patent Number: 4,890,347

[45] Date of Patent: Jan. 2, 1990

[54] INTERCHANGEABLE DETACHABLE DECORATIVE APPLIQUE

[76] Inventor: Claudia A. Fuller, 1050 Waverly Ave., Holtsville, N.Y. 11742

[21] Appl. No.: 201,465

[22] Filed: Jun. 2, 1988

[51] Int. Cl.[4] ..... A47C 31/10

[52] U.S. Cl. ..... 5/508; 5/482; 428/79; 428/100

[58] Field of Search ..... 5/508 X, 482, 485, 486; D6/595, 598, 596, 600, 602, 603, 606; 2/49 R; 428/79 X, 100 X

[56] References Cited

U.S. PATENT DOCUMENTS

| | | | |
|---|---|---|---|
| 2,078,022 | 4/1937 | Roemer | 5/482 X |
| 3,579,675 | 5/1971 | Scheer | D6/598 X |
| 3,608,092 | 9/1971 | Taranto | 2/49 R |
| 3,777,310 | 12/1973 | Yang | 2/48 |
| 3,965,504 | 6/1976 | Ainsworth | 5/485 |
| 4,710,979 | 12/1987 | Bull | 2/49 R X |
| 4,750,225 | 6/1988 | Simons et al. | 5/485 |

*Primary Examiner*—Alexander Grosz
*Assistant Examiner*—Michael Milano
*Attorney, Agent, or Firm*—Richard L. Miller

[57] ABSTRACT

This detachable decorative applique piece is designed to be fastened to a comforter or bedspread to enhance their decorative appearances. Primarily, an ornamental design combination composed of colorful fabric including attached peel-away fasteners that matingly engage with similar fasteners, enabling quick attachment and quick removal of the piece from the comforter or bedspread. The design further includes a pocket portion defined between the bedspread and the design, for storage of any desired article or articles.

3 Claims, 1 Drawing Sheet

FIG. 1
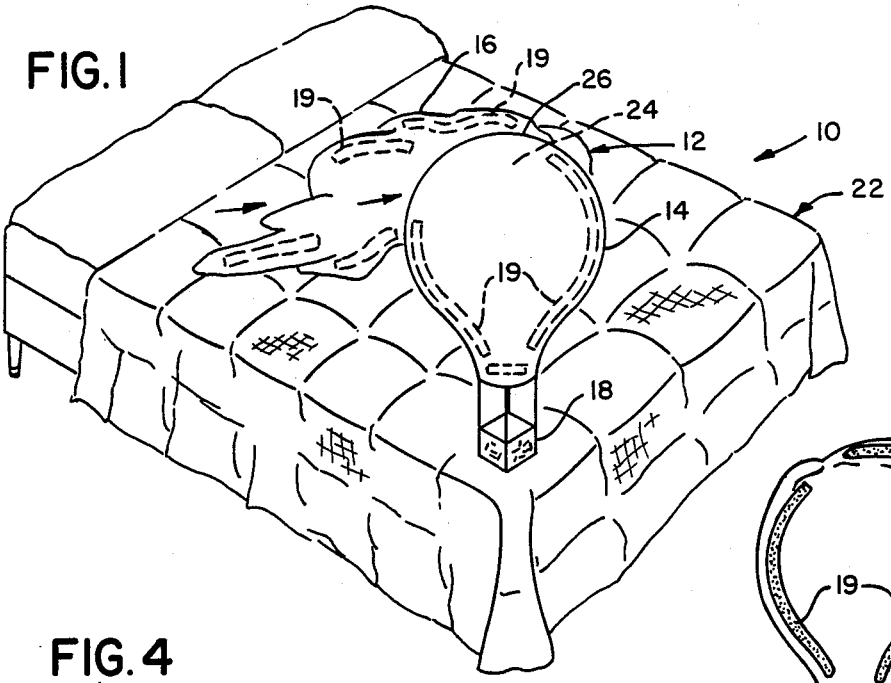
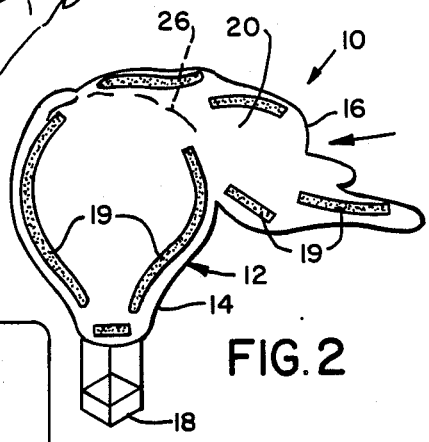
FIG. 2
FIG. 4
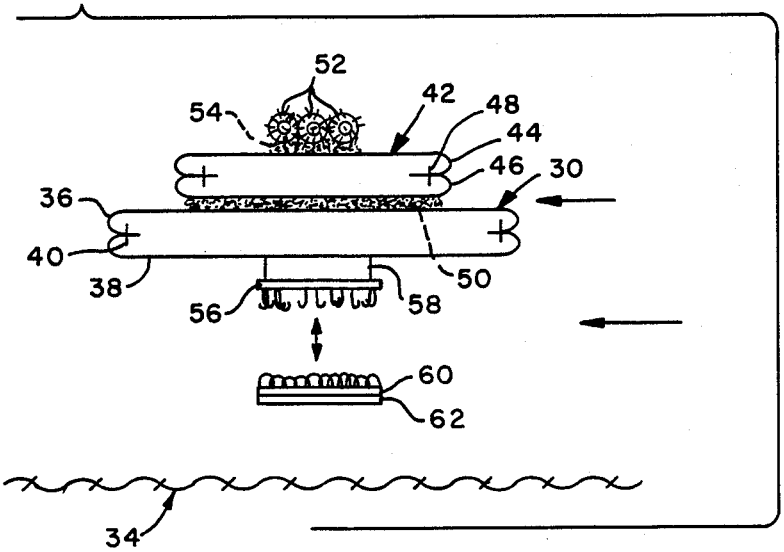
FIG. 3
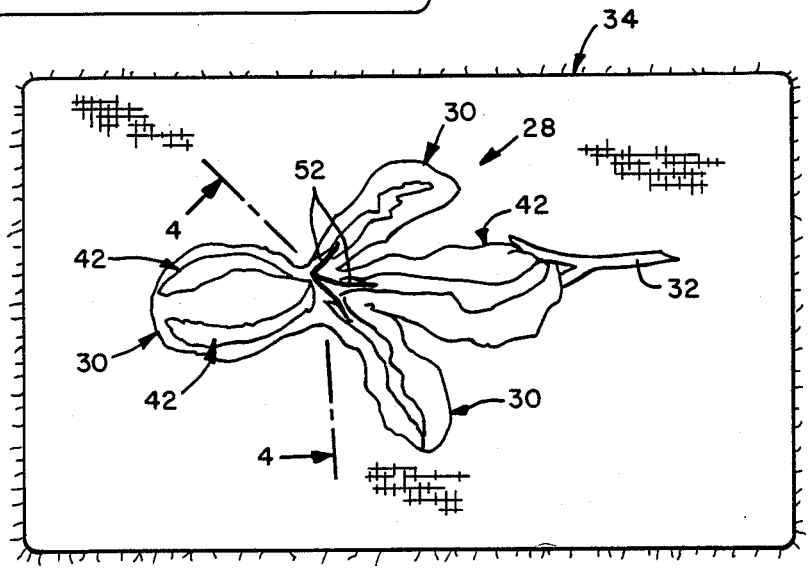

INTERCHANGEABLE DETACHABLE DECORATIVE APPLIQUE

BACKGROUND OF THE INVENTION

The instant invention relates generally to decorative devices for bedspreads and the like, and more particularly, to an interchangeable detachable decorative applique.

Numerous decorative devices have been provided in the prior art that are adapted to be applied to bedspreads and the For example, U.S. Pat. No. 4,590,633 of Pickens, 4,062,076 of Albertson, and 3,120,721 of Bukatman et al, all are illustrative of such prior art. While these units may be suitable for the particular purpose to which they address, they would not be as suitable for the purpose of the present invention as hereafter described.

SUMMARY OF THE INVENTION

A primary object of the present invention is to provide an interchangeable detachable decorative applique that will overcome the shortcomings of the prior art devices.

Another object is to provide an interchangeable detachable decorative applique that will be a piece of art work made of fabric which will be attachable and releasable from a bedspread, comforter or other bed covering, and it will be washable.

An additional object is to provide an interchangeable detachable decorative applique that will be attachable by hook and loop pile fasteners.

A further object is to provide an interchangeable detachable decorative applique that is simple and easy to use.

A still further object is to provide an interchangeable detachable decorative applique that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention shown installed on a bed;

FIG. 2 is a bottom plan view of the balloon and cloud piece shown removed therefrom;

FIG. 3 is a top plan view of another typical embodiment of the invention; and FIG. 4 is a diagrammatic cross sectional view taken along line 4—4 in FIG. 3.

DETAILED DESCRIPTION OF THE PREFERRED EMBODIMENTS

Turning now descriptively to the drawings, in which like reference characters denote like elements throughout the several views, an applique piece 10 is shown to include a typically balloon portion 14 having an attached cloud portion 16 and a basket portion 18 at its bottom. A plurality of mating hook and loop pile fasteners 19 are fixedly secured to a rear surface 20 and comforter 22 in a suitable manner (not shown), for removably attaching piece 10 to comforter 22, and a pocket 24 is defined in the balloon area between the upper pile fasteners 19 and their similar fasteners 19 that mate and are attached to comforter 22, and the entrance to the pocket 24 is provided for at the upper outer peripheral edge 26. This pocket 24 provides for receiving any desired article, such as, a handkerchief, pajamas, etc.

In use, the applique piece 10 is pressed in place on comforter 22 by urging down on the hook and loop pile fasteners 19, and when it is desired to remove same, the applique piece 10 is just peeled apart from the mating fasteners 19 on the comforter 22, whereupon it may be easily laundered and stored and another piece 10 may be interchanged in its place.

Referring now to FIGS. 3 and 4, an interchangeable modified piece 28 of a flower design is shown to include colorful petals 30 and an attached stem portion 32, which in this instance is illustrated attached to a bedspread 34. Petals 30 are formed of a colored ornamental fabric 36 that is fastened to a backing 38 by stitches 40, and center portions 42 consist of colored ornamental fabric 44 fastened to a backing 46 by stitches 48. The backing 46 is fixedly secured to fabric 36 of petal 30 by an adhesive 50, and a plurality of colored and braided pipe cleaners 52 ornamentally decorate the center portion of the flower design and are fixedly secured to the design by adhesive 54.

A hook pile fastener 56 is fixedly secured to the outside of backing 38 by stitches 58, and hook pile fasteners 56 removably engage with loop pile fasteners 60 (one of which is shown), that includes a disposable strip 62 that is adhered to an adhesive side of each loop pile fastener 60. The above is so designed, as to enable application of the modified piece 28 to any bedspread, comforter, etc.

In use, modified piece 28 is applied to bedspread 34 by first positioning piece 28 in the desired location on the bedspread 34. After the above is accomplished, the location of the attached hook pile fasteners 56 is marked on the bedspread 34 in a suitable manner, and the disposable strips 62 are removed by peeling away from the adhesive side of the loop pile fasteners 60. When the above has been fully accomplished, the petals 30 are pressed in place and remain in place by the hook and loop pile fasteners 56 and 60.

It is to be further understood that the choice of the ornamental design for the appliques is unlimited and that the balloon and flower shown here are only typical illustrations.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An interchangeable detachable decorative applique for an article such as a bedspread, comforter or the like, comprising:

(a) a first fabric piece having a top surface and a bottom surface;

(b) a second fabric piece fixedly inserted to the top surface of said first fabric piece;

(c) a plurality of braided pipe cleaners fixedly secured to the top of said second fabric piece; and, (d) first and second fastener means, one of said fastener means including a hook pile fastener and the other of said fastener means including a loop pile fastener, a plurality of said first fastener means being fixedly attached at spaced locations to the bottom surface of said first fabric piece and a plurality of said second fastener means being fixedly attached to said article at a location immediately opposite said first fastener means whereby said first and second fastener means removably adhere to each other.

2. An applique as in claim 1 in which said second fastener means comprises a two-sided strip with said pile fastener on one side and an adhesive on the other side, and a disposable protective covering over said adhesive, said covering being removable so that said adhesive will adhere to said article.

3. An applique as in claim 1 and including a first backing fixedly secured to the back of said first fabric piece, and a second backing fixedly secured to the back of said second fabric piece.

* * * * *